US005828208A

United States Patent [19]

Oku

[11] Patent Number: 5,828,208

[45] Date of Patent: Oct. 27, 1998

[54] VOLTAGE REGULATOR USABLE WITHOUT DISCRIMINATION BETWEEN INPUT AND OUTPUT TERMINALS

[75] Inventor: Koichiro Oku, Tokyo, Japan

[73] Assignee: NEC Corporation, Tokyo, Japan

[21] Appl. No.: 900,350

[22] Filed: Jul. 25, 1997

[30] Foreign Application Priority Data

Jul. 26, 1996 [JP] Japan ..... 8-198185

[51] Int. Cl.[6] ..... G05F 1/40

[52] U.S. Cl. ..... 323/282

[58] Field of Search ..... 323/223, 282, 323/285

[56] References Cited

U.S. PATENT DOCUMENTS 5,397,976 3/1995 Madden et al. ..... 323/282
5,469,046 11/1995 Wong et al. ..... 323/282
5,604,426 2/1997 Okamura et al. ..... 323/282

*Primary Examiner*—Stuart N. Hecker
*Attorney, Agent, or Firm*—Whitham, Curtis & Whitham

[57] ABSTRACT

A voltage regulator has a pair of common terminals (101, 102) and a pair of rectifying diodes (103, 104) which are connected to the common terminals, respectively. The rectifying diodes supplies an input voltage which is supplied to one of the common terminals to a connecting point (105) of the rectifying diodes. Resistors (107, 108, 109, 110), a comparator (111), and a switch (112) selectively couple a dividing resistor (17) with one of the common terminals that is not supplied with the input voltage. A MOSFET (106) is connected to the common terminals so as to amplify an input voltage supplied to one of the common terminals and so as to provide an output voltage to the other terminal. A constant current source (14), a start up circuit (15), a reference voltage producing circuit (16), an error amplifier (19) control the MOSFET so that a reference voltage $V_{REF}$ produced by the reference voltage producing circuit is equal to a divided voltage $V_O$ produced by dividing resistor (17,18).

12 Claims, 10 Drawing Sheets

CHARGE : SW1 ON, SW2 OFF
DISCHARGE : SW1 OFF, SW2 ON

VOLTAGE REGULATOR USABLE WITHOUT DISCRIMINATION BETWEEN INPUT AND OUTPUT TERMINALS

BACKGROUND OF THE INVENTION

This invention relates to a voltage regulator which regulates an input voltage so as to stabilize an output voltage provided to an output terminal. Specially, this invention relates to a three terminal voltage regulator which has an input terminal, an output terminal, and a ground terminal.

A conventional three terminal voltage regulator has an input terminal supplied with an input voltage from a power source, an output terminal for providing an output voltage to an external circuit and a reference terminal which is usually grounded and which may be called a ground terminal. A reference voltage generator is connected across the input and the ground terminals and generates a reference voltage in response to the input voltage. A voltage divider is connected between the output terminal and the ground terminal and divides the output voltage to produce a divided internal voltage. An error amplifier is connected to the reference voltage generator and the voltage divider and amplifies an error between the reference voltage and the divided internal voltage to produce an amplified error signal. An output amplifier is connected to the input and the output terminals and the error amplifier and amplifies the input voltage in response to the amplified error signal to produce the output voltage.

In this structure, when the output terminal is supplied with the input voltage by an oversight, the three terminal voltage regulator will be destroyed by the input voltage in the worst case. Even though the three terminal voltage regulator is not destroyed by the input voltage, the three terminal voltage regulator will be degraded in characteristic. Consequently, the input terminal and the output terminal must be strictly distinguished from each other when it is used.

In addition, it often happens that the conventional three terminal voltage regulator can be used for either charging or discharging a secondary battery. In this event, two of the conventional three terminal voltage regulators should be prepared to charge and to discharge the secondary battery. This is because the input terminal and the output terminal must be distinguished from each other.

SUMMARY OF THE INVENTION

It is therefore an object of this invention to provide a voltage regulator which is usable without discrimination between an input terminal and an output terminal.

It is another object of this invention to provide a voltage regulator which can singly cope with charging and discharging a secondary battery.

Other objects of this invention will become clear as the description proceeds.

In order to understand the gist of this invention, it should be noted that a voltage regulator regulates an input voltage which is supplied to an input terminal so as to stabilize an output voltage which is provided to an output terminal.

According to an aspect of this invention, the voltage regulator comprises a pair of common terminals one of which is used as the input terminal and the other of which is used as the output terminal. A pair of rectifying diodes are connected to the common terminals, respectively, and are connected to each other at a connecting point. The rectifying diodes rectify current from the common terminals to the connecting point so as to supply the input voltage to the connecting point. A detecting unit detects the output voltage to produce a detecting voltage in proportion to the output voltage. A control unit is connected to the connecting point and the detecting unit and produces a control signal in response to the input voltage and the detecting voltage. An output amplifying unit is connected to the common terminals and the control unit and amplifies the input voltage which is supplied from one of the common terminals in response to the control signal to produce the output voltage which is provided to the other of the common terminals. A selecting unit is connected to the common terminals unit and the detecting unit and selectively electrically couples one of the common terminals with the detecting unit to supply the output voltage to the detecting means.

DESCRIPTION OF THE PREFERRED EMBODIMENTS

Referring to FIGS. 1 through 5, description will be at first directed to a conventional voltage regulator for a better understanding of this invention.

Figure 1:
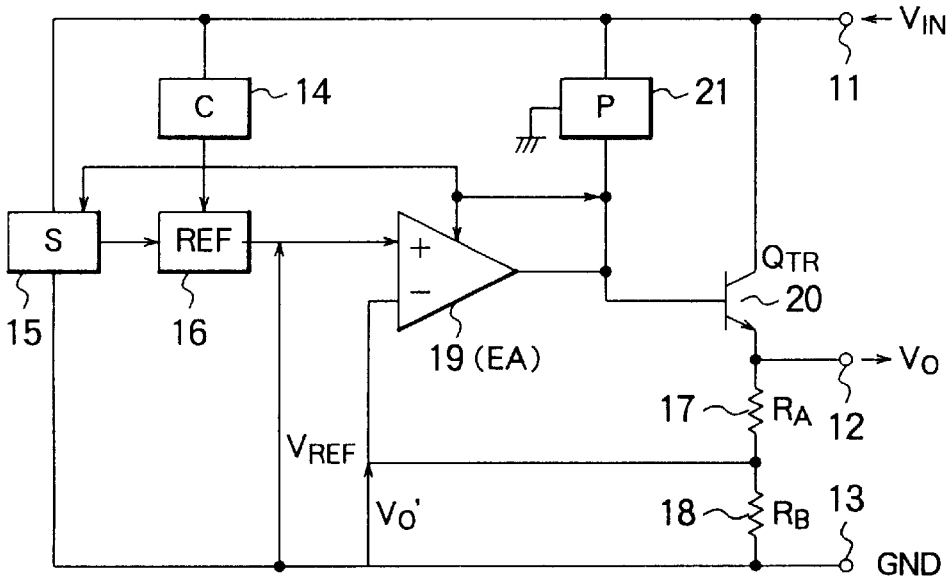
FIG. 1 PRIOR ART
FIG. 1 is a block diagram of a conventional three terminal voltage regulator.

In FIG. 1, a conventional three terminal voltage regulator has an input terminal 11, an output terminal 12, and a reference or ground terminal (GND) 13. A constant current source (C) 14 is connected to the input terminal 11 and gives a constant current when the input terminal 11 is supplied with an input voltage $V_{IN}$. A start-up circuit (S) 15 is connected to the input terminal 11, the ground terminal 13, and the constant current source 14 to produce a start-up signal in response to the input voltage $V_{IN}$. A reference voltage producing circuit (REF) 16 is connected to the ground terminal 13, the constant current source 14, and the start-up circuit 15 to produce a reference voltage $V_{REF}$ in response to the start-up signal supplied from the start-up circuit 15.

Resistors ($R_A$) 17 and ($R_B$) 18 which are connected in common to each other at a point are connected between the output terminal 12 and the ground terminal 13 and are operable as an output voltage divider. In this connection, the resistors 17 and 18 may be refereed to as output voltage dividing resistors. Specifically, the output voltage dividing resistors 17 and 18 divide an output voltage $V_O$ supplied to the output terminal 12 and produce a divided voltage $V_O'$.

An error amplifier (EA) 19 has a noninverting input terminal (+) connected to the reference voltage producing circuit 16, an inverting input terminal (−) connected to the point of connection between the output voltage dividing resistors 17 and 18, and a power input terminal connected to the constant current source 14. The error amplifier (EA) 19 amplifies an error or a difference between the reference voltage $V_{REF}$ and the divided output voltage $V_O'$ and produces an amplified error signal.

An output power transistor ($Q_{TR}$) 20 has a collector connected to the input terminal 11, an emitter connected to the output terminal 12, and a base connected to both of the constant current source 14 and the error amplifier 19. The output power transistor 20 amplifies the input voltage $V_{IN}$ in response to both the amplified error signal and the constant current and produces the output voltage $V_O$. A protecting circuit 21 is connected to the input terminal 11 and the base of the output power transistor 20 so as to protect the output power transistor 20 from causing an excessive amount of a current to flow therethrough. There are $\mu$ PC7900 series which are manufactured and sold by NEC corporation as this sort of the three terminal voltage regulator.

In this structure, when the input terminal 11 is supplied with the input voltage $V_{IN}$ which is higher than a voltage between the output terminal 12 and the ground terminal 13, the three terminal voltage regulator regulates the input voltage $V_{IN}$ and stabilizes the output voltage $V_O$ so that the divided voltage $V_O'$ becomes equal to the reference voltage $V_{REF}$.

By the way, the three terminal voltage regulator is realized as an integrated circuit. Then, the output power transistor 20 and the output voltage dividing resistor 17 and 18 are formed as illustrated in FIG. 2.

Figure 2:
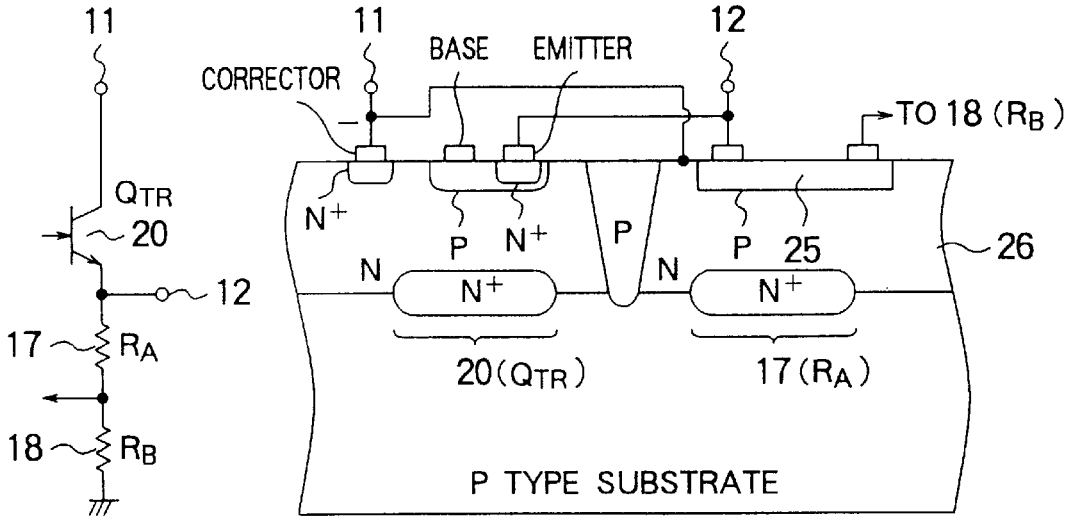
FIG. 2 PRIOR ART
FIG. 2 shows a sectional view of an output power transistor and an output voltage dividing resistor of FIG. 1.

In FIG. 2, the output power transistor 20 and the output voltage dividing resistor 17 are isolated from each other by a PN junction which is formed by a P type diffused layer 25 and an N type diffused layer 26. This means that the input terminal 11 is given a highest electric potential in the three terminal voltage regulator when the input terminal 11 is supplied with a positive input voltage $V_{IN}$.

Specifically, the input terminal 11 is connected to the N type diffused layer 26 of the output voltage dividing resistor 17 so that a backward bias is supplied between the P type diffused layer 25 and the N type diffused layer 26.

In this structure, if the output terminal 12 is supplied with the positive input voltage $V_{IN}$, a latch down phenomenon is caused to occur between the output voltage dividing resistor 17 and the output power transistor 20. Namely, a forward bias is supplied between the P type diffused layer 25 and the N type diffused layer 26 and an undesirable current flows from the output terminal 12 to the input terminal 11 as illustrated by a broken line and arrows in FIG. 3. Thus, the PN junction is designed so as not to be supplied with the forward bias. Accordingly, the PN junction might be degraded or destroyed by the forward bias. This requires an exterior protecting diode (not shown) between the input terminal 11 and the output terminal 12. Such a latch down phenomenon can be prevented by the use of the exterior protecting diode, as mentioned above.

Figure 4:
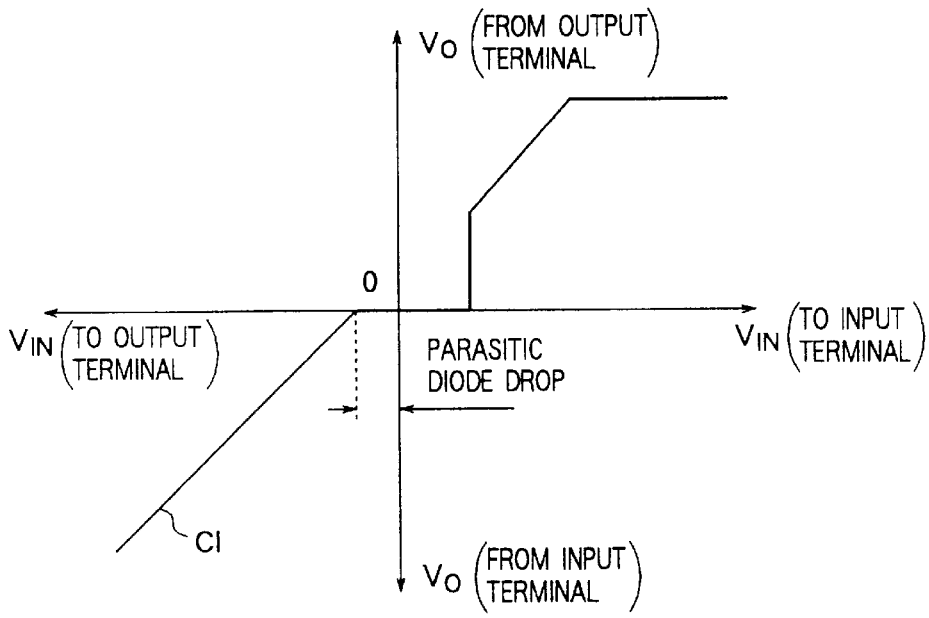
FIG. 4 PRIOR ART
FIG. 4 is a graph of an input-output characteristic of the conventional three terminal voltage regulator of FIG. 1.

When the PN junction is not damaged by the forward bias, the three terminal voltage regulator has input-output characteristics as shown in FIG. 4.

In FIG. 4, a righthand side of the abscissa is representative of the input voltage $V_{IN}$ which takes a positive voltage and which is supplied to the input terminal 11. A lefthand side of the abscissa is representative of the input voltage $V_{IN}$ which takes a positive voltage and which is supplied to the output terminal 12. An upper side of the ordinate is representative of the output voltage $V_O$ which takes a positive voltage and which is detected by the output terminal 12. A lower side of the ordinate is representative of the output voltage $V_O$ which takes a positive voltage and which is detected by the output terminal 12.

Figure 3:
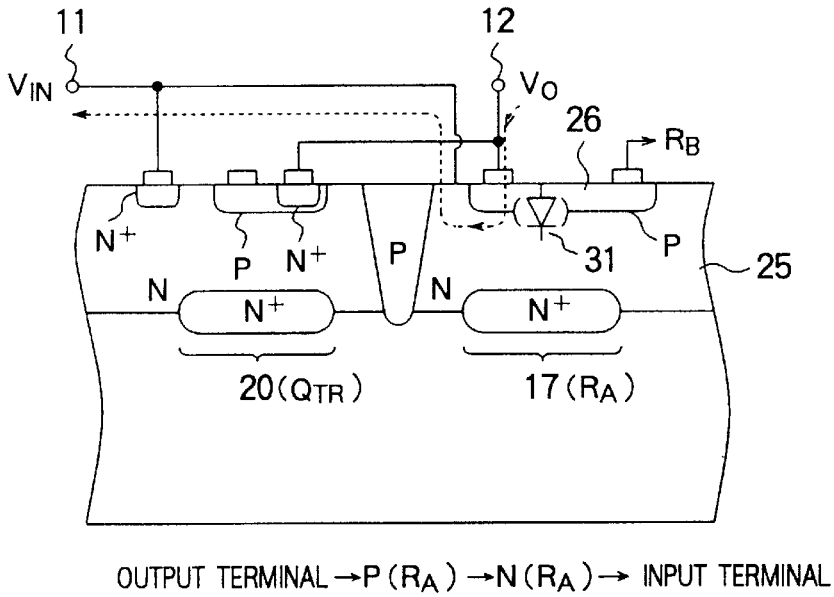
FIG. 3 PRIOR ART
FIG. 3 shows a sectional view for use in describing a latch down phenomenon.

It is easily understood by reference to FIG. 4 that the output voltage $V_O$ is in proportion to the input voltage $V_{IN}$ as shown by a curve Cl when the output terminal is supplied with the input voltage $V_{IN}$ which is higher than a fixed voltage. The fixed voltage is decided by a parasitic diode 31 which is shown in FIG. 3 and which is formed by the P type diffused layer 25 and the N type diffused layer 26 shown in FIG. 3. The fixed voltage is usually called a parasitic diode drop. Accordingly, the three terminal voltage regulator can not produce a stabilized output voltage when the input voltage $V_{IN}$ is supplied to the output terminal 12.

Figure 5:
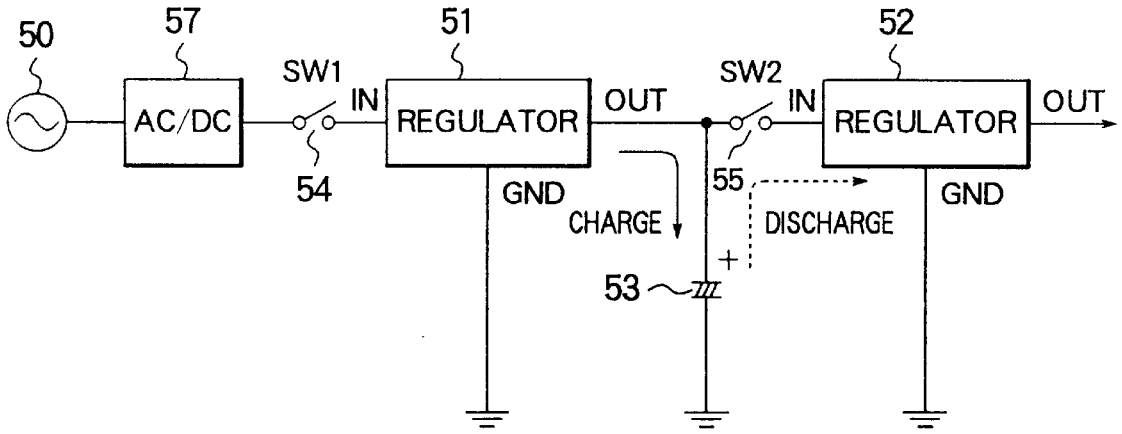
FIG. 5 PRIOR ART
FIG. 5 is a block diagram of a conventional charging and discharging circuit.

In addition, two of the three terminal voltage regulators are necessary so as to charge and discharge a secondary battery as shown in FIG. 5.

In FIG. 5, two of the three terminal voltage regulators 51 and 52 are combined together so as to form a circuit for charging and discharging a secondary battery 53. More particularly, the three terminal voltage regulator 51 has the input terminal (IN) connected to a first switch (SW1) 54 and the output terminal (OUT) connected to the secondary battery 53 and a second switch (SW2) 55. The first switch 54 is connected to a power source 56 through an AC-DC converter 57. The other three terminal voltage regulator 52 has the input terminal (IN) connected to the second switch 55 and the output terminal (OUT) connected to an external circuit (not shown).

When the first switch 54 is closed and the second switch 55 is opened, the secondary battery 53 is charged. On the other hand, when the first switch 51 is opened and the second switch 55 is closed, the secondary battery 53 is discharged.

However, when such a circuit is housed in a package, the two of the three terminal voltage regulators 51 and 53 renders the package large in size and becomes expensive.

Figure 6:
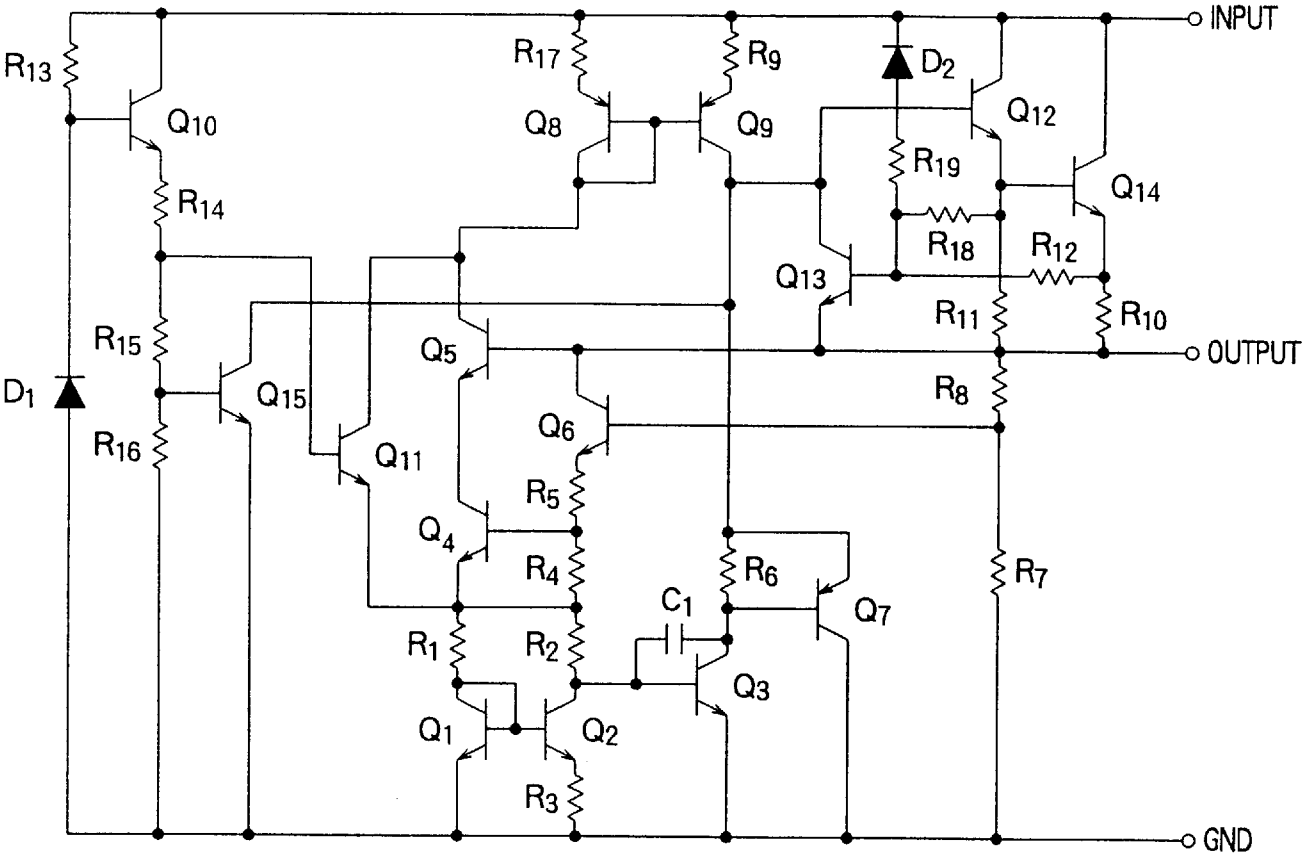
FIG. 6 PRIOR ART
FIG. 6 is a circuit diagram of another conventional three terminal voltage regulator.
Figure 7:
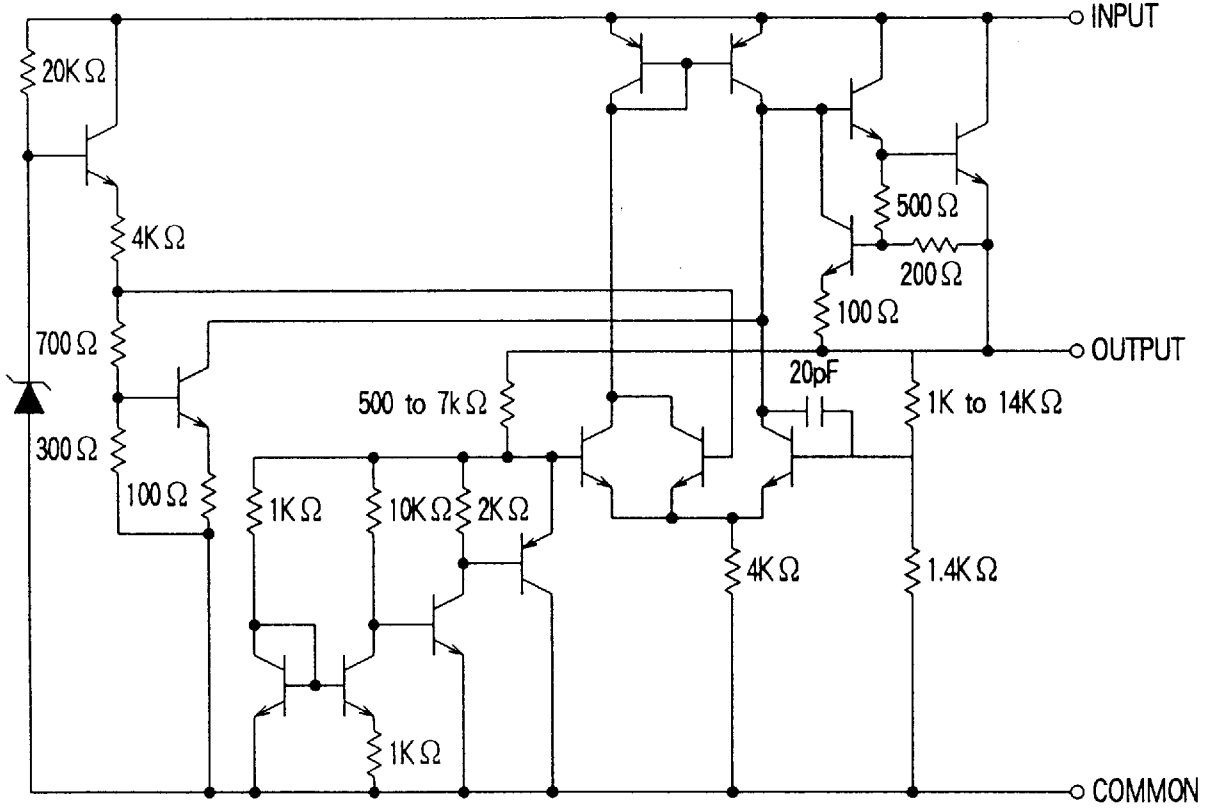
FIG. 7 PRIOR ART
FIG. 7 is a circuit diagram of still another conventional three terminal voltage regulator.
Figure 8:
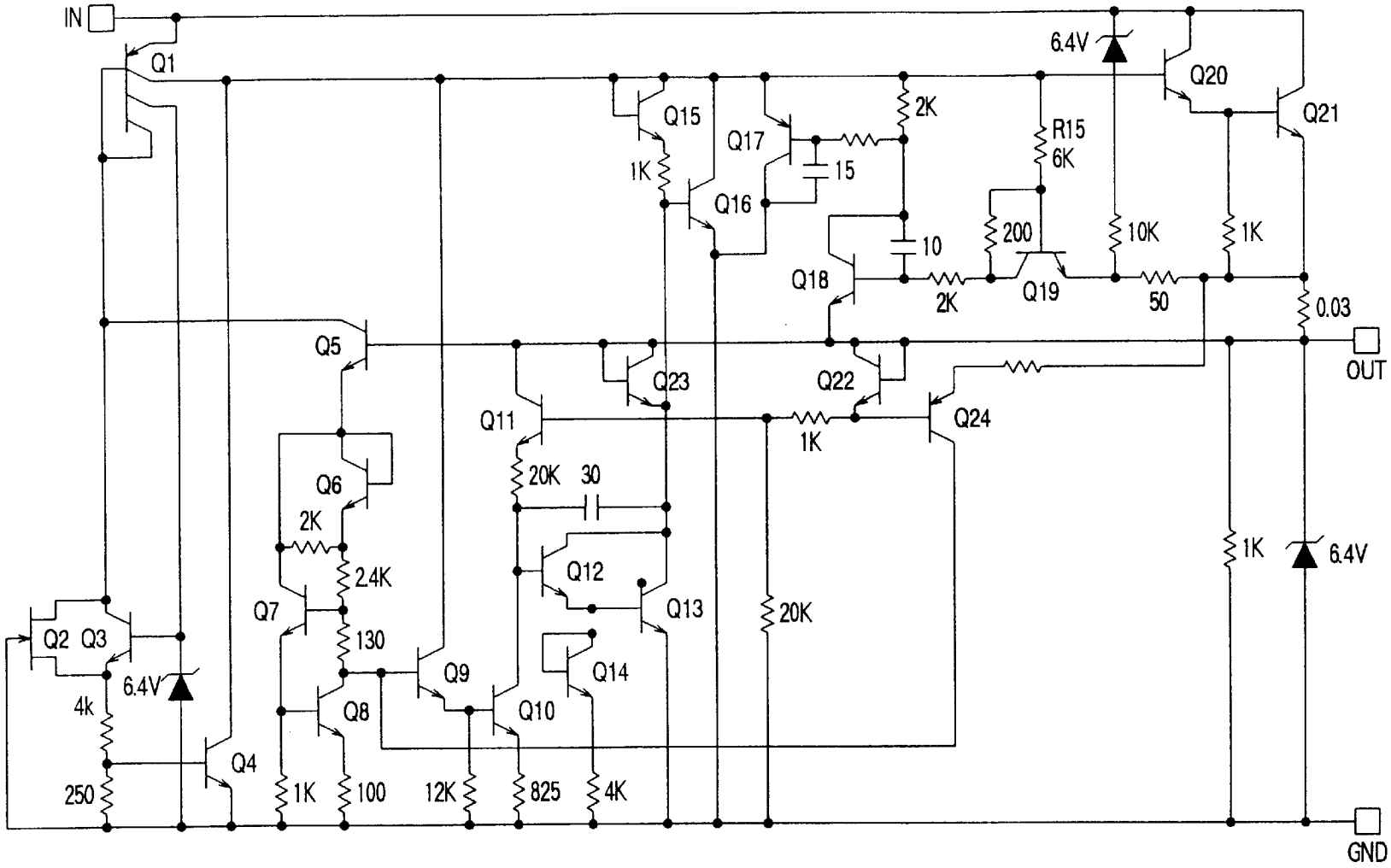
FIG. 8 PRIOR ART
FIG. 8 is a circuit diagram of yet another conventional three terminal voltage regulator.
Figure 9:
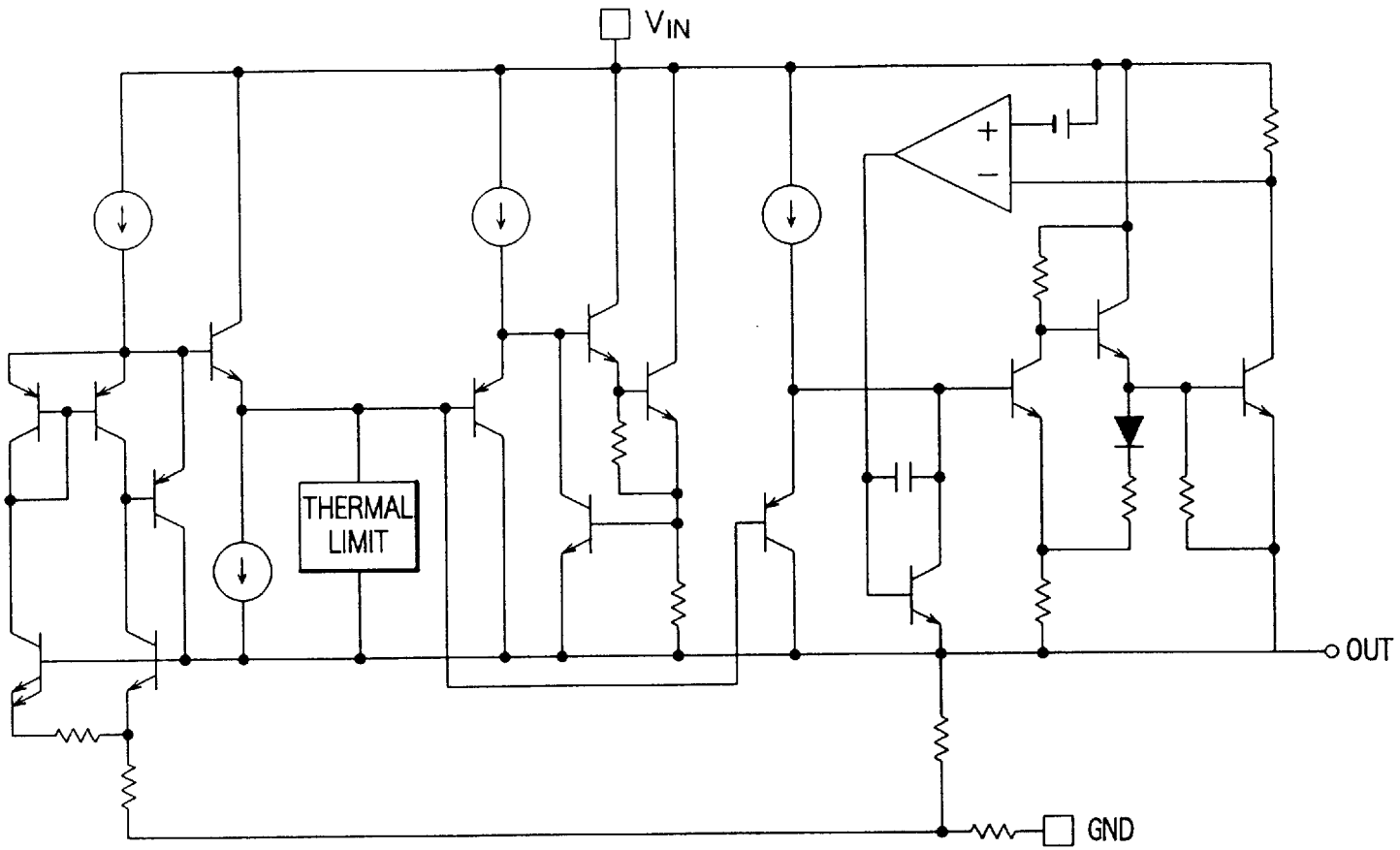
FIG. 9 PRIOR ART
FIG. 9 is a circuit diagram of another conventional three terminal voltage regulator.

A wide variety of voltage regulators have been known in the art and may practically be manufactured and sold in the names of $\mu$ PC78L00 series and $\mu$ A78Lxx series by NEC corporation and TEXAS Instruments, as shown in FIGS. 6 and 7, respectively. Likewise, voltage regulators as shown in FIGS. 8 and 9 have been also manufactured and sold by Linear Technology corporation. However, the voltage regulators illustrated in FIGS. 6 to 9 have the same defects as the three terminal voltage regulator of FIG. 1.

Figure 10:
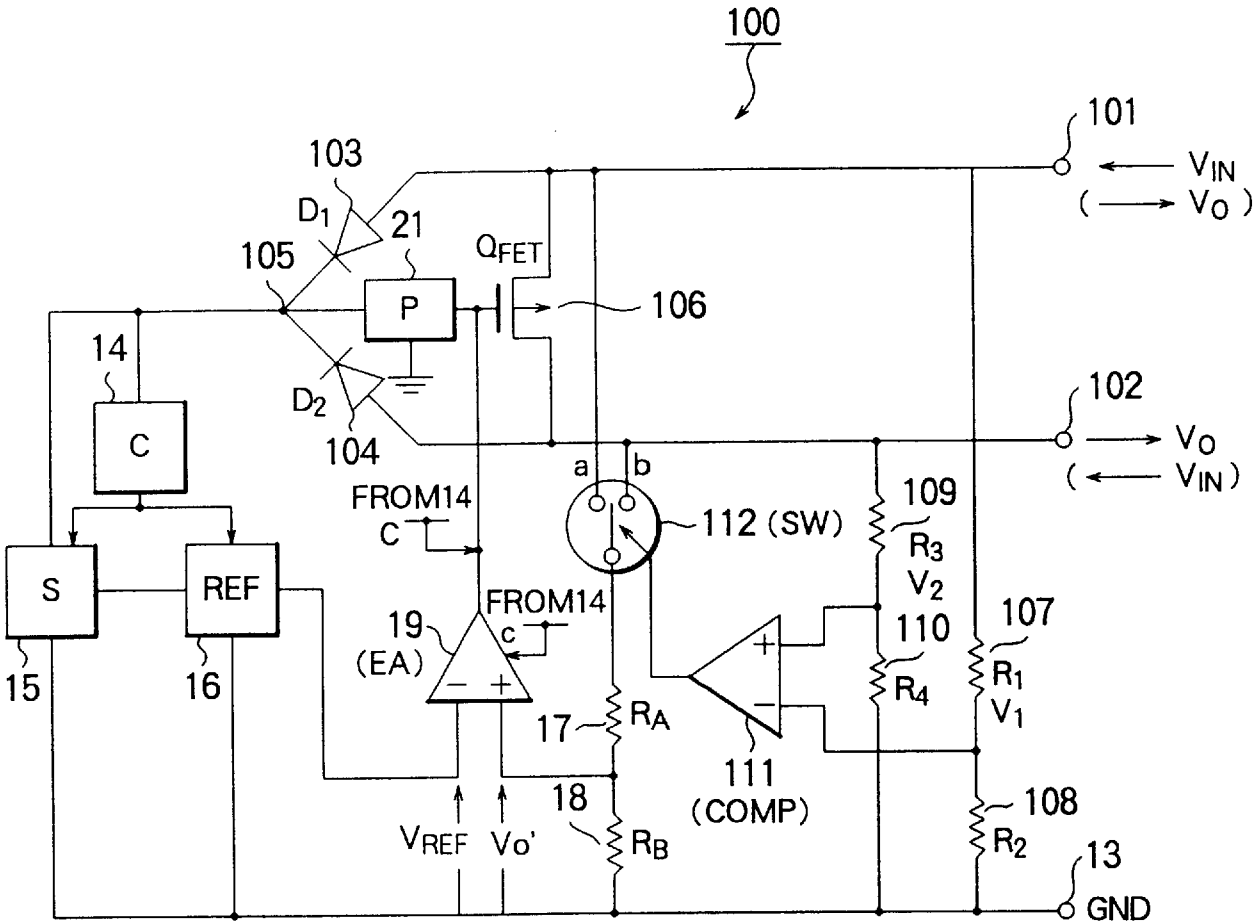
FIG. 10 is a block diagram of a three terminal voltage regulator according to a preferable embodiment of this invention.
Figure 11:
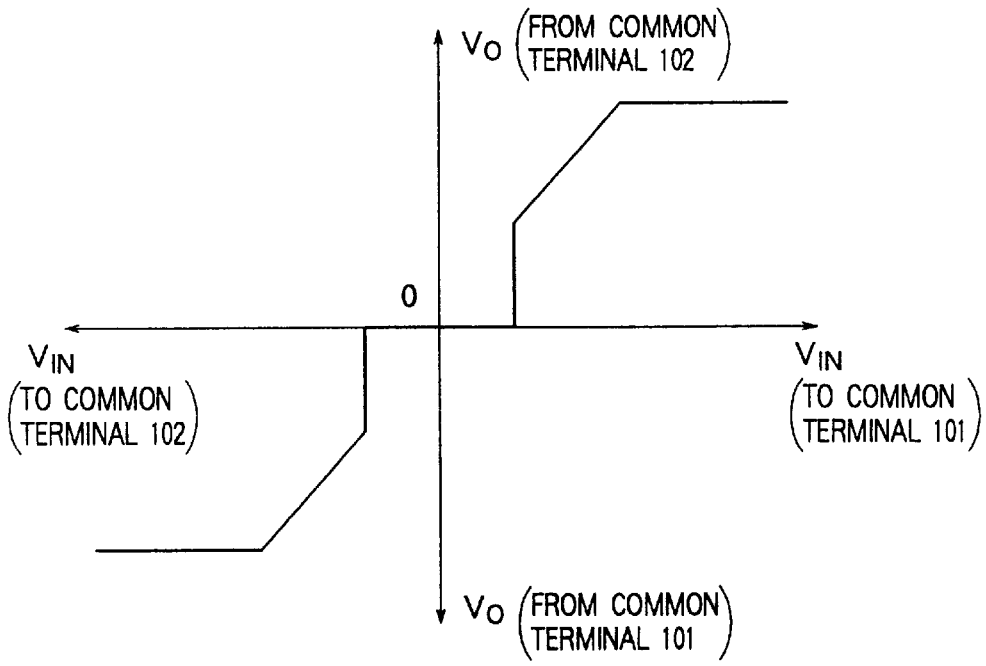
FIG. 11 is a graph of an input-output characteristic of the three terminal voltage regulator of FIG. 10.
Figure 12:
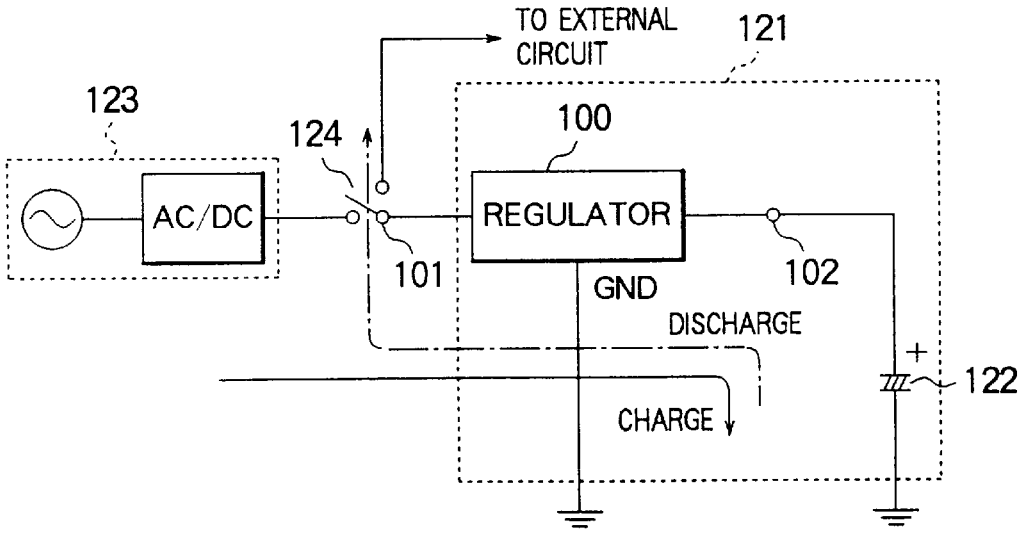
FIG. 12 is a block diagram for use in describing charging and discharging operation by the use of the three terminal voltage regulator of FIG. 10.

Referring to FIGS. 10 through 12, description will be made about a three terminal voltage regulator according to a preferred embodiment of this invention. Similar parts are designated by like reference numerals and symbols.

In FIG. 10, the three terminal voltage regulator (depicted by 100) has two input/output terminals 101 and 102 which may be called common terminals. When one of the common terminals is used as an input terminal, the other common terminal is used as an output terminal. To the contrary, when one is used as the output terminal, the other is used as the input terminal. Two rectifying diodes ($D_1$) 103 and ($D_2$) 104 are connected to the common terminals 101 and 102, respectively, and are connected to each other at a point 105 of connection. In the illustrated example, the rectifying diodes 103 and 104 are assumed to have the same characteristics.

With this structure, when the common terminals 101 and 102 are given voltages different from each other, a higher one of the voltages appears at the point 105 of connection through either one of the diodes 103 and 104.

The constant current source (C) 14, the start-up circuit 15, and the protecting circuit (P) 21 are connected to the point 105.

A P channel power MOSFET (metal-oxide semiconductor field-effect transistor: $Q_{FET}$) 106 has a gate and drain and source. The gate of the MOSFET 106 is connected to the protecting circuit 21 and the error amplifier 19. The drain and the source are connected to the common terminals 101 and 102, respectively. The P channel power MOSFET 106 amplifies the higher voltage supplied to one of the common terminals 101 and 102 in response to the amplified error signal supplied from the error amplifier 19 and provides amplified voltage to the other terminal. Namely, the P channel power MOSFET 106 operates as a two-way amplifier.

First and second dividing resistors ($R_1$) 107 and ($R_2$) 108 are connected to each other between the common terminal 101 and the ground terminal 13 so as to divide the voltage supplied to the common terminal 101. Third and fourth dividing resistors ($R_3$) 109 and ($R_4$) 110 are connected to each other between the common terminal 102 and the ground terminal 13 so as to divide the voltage supplied to the common terminal 102. The first, second, third, and forth dividing resistors have first, second, third, and fourth resistances, respectively. A first ratio of the first resistance to the second resistance is substantially equal to a second ratio of the third resistance to the forth resistance.

A comparator (COMP) 111 has an inverting input terminal (−) which is connected to the first and the second dividing resistors 107 and 108 and a noninverting input terminal (+) which is connected to the third and the fourth dividing resistors 109 and 110. The comparator 111 compares a first divided voltage ($V_1$) developed across the second dividing resistor 108 with a second divided voltage ($V_2$) across the fourth dividing resistor 110 and produces a comparison signal representative of a result of the comparison.

A switch (SW) 112 is connected to the common terminals 101 and 102, the comparator 111, and the output voltage dividing resistor 17 so as to electrically couple the output voltage dividing resistor 17 with one of the common terminals 101 and 102 in response to the comparison signal supplied from the comparator 111.

Namely, the switch 112 selects a lower one of the voltages given to the common terminals 101 and 102 and sends the lower voltage to the output voltage dividing resistor 17.

Operation of the three terminal voltage regulator 100 will be described in the following.

At first, the first and the second dividing resistors 107 and 108 divide the voltage between the common terminal 101 and the ground terminal 13 so as to produce the first divided voltage $V_1$. The third and the forth dividing resistors 109 and 110 divide the voltage between the common terminal 102 and the ground terminal 13 so as to produce the second divided voltage $V_2$. If an input voltage, such as the higher voltage, is supplied to either one of the common terminals 101 and 102, there is a difference between the first divided voltage $V_1$ and the second divided voltage $V_2$.

The comparator 111 compares the first divided voltage $V_1$ with the second divided voltage $V_2$. When the first divided voltage V1 is higher than the second divided voltage V2, the comparator 111 produces a logic signal of a high level as the comparison signal. On the other hand, when the first divided voltage V1 is lower than the second divided voltage V2, the comparator 111 produces a logic signal of a low level as the comparison signal.

The switch 112 electrically couples the output voltage dividing resistor 17 with the common terminal 101 in response to the logic signal of the high level from the comparator 111.

On the other hand, the switch 112 electrically couples the output voltage dividing resistor 17 with the common terminal 102 in response to the logic signal of the low level from the comparator 111. As a result, the other of the common terminal 101 and 102 which is not supplied with the input voltage is coupled with the output voltage dividing resistor 17 by the switch 112. For example, the common terminal 102 is coupled with the output voltage dividing resistor 17 by the switch 112 when the input voltage is supplied to the common terminal 101. When the input voltage is supplied to the common terminal 102, the common terminal 101 is coupled with the output voltage dividing resistor 17 by the switch 112.

As a result, the output voltage dividing resistor 17 is never supplied with the input voltage and the latch down phenomenon can be prevented. Accordingly, an exterior protect diode is not connected between the common terminals 101 and 102.

On the other hand, the point 105 of connection is supplied with the higher voltage between the voltage of the common terminals 101 and 102. Namely, the input voltage appears at the point 105 of connection when the input voltage is given to one of the common terminal. Accordingly, the constant current circuit 14, the start-up circuit 15, and the protecting circuit 21 are supplied with the input voltage and operate in a manner similar to those of the conventional three terminal voltage regulator of FIG. 1. Moreover, the reference voltage producing circuit 16 operates like that of the conventional three terminal voltage regulator of FIG. 1.

The error amplifier 19 amplifies the error between the reference voltage supplied from the reference voltage producing circuit 16 and the divided output voltage supplied from the output voltage dividing resistors 17 and 18 so as to produce the amplified error signal. Herein, it is noted that the noninverting terminal and the inverting terminal are connected contrary to those of the conventional three terminal voltage regulator. This is because the P channel MOSFET 106 is used in place of the output power transistor 20 of FIG. 1.

When the reference voltage $V_{REF}$ appearing at the inverting terminal is higher than the divided output voltage $V_O'$ appearing at the noninverting terminal, then the error amplifier 19 decreases the amplified error signal. In this event, the P channel MOSFET 106 increases the output voltage $V_O$ with a decrease of the amplified error signal.

On the other hand, when the reference voltage $V_{REF}$ is lower than the divided output voltage $V_O'$, then the error amplifier 19 increases the amplified error signal. This brings about a decrease of the output voltage $V_O$ of the P channel MOSFET 106 as the amplified error signal increases. Thus, the three terminal voltage regulator 100 regulates the input voltage and stabilizes the output voltage $V_O$ so that the reference voltage $V_{REF}$ is equal to the divided output voltage $V_O'$.

The three terminal voltage regulator 100 has input-output characteristics as illustrated in FIG. 11. It is easily understood by reference to FIG. 11 that either of the common terminals 101 and 102 can be used as the input terminal. Namely, when one of the common terminals 101 and 102 is used as the input terminal, the other provides the output voltage $V_O$. In other words, the common terminals 101 and 102 can be used without distinction between the input terminal and the output terminal.

The three terminal voltage regulator 100 can be singly used for a charging and discharging circuit as shown in FIG. 12.

In FIG. 12, the three terminal voltage regulator 100 forms a battery package 121 together with a secondary battery 122. One of the common terminals 101 and 102 is connected to the secondary battery 122 and the other is extended to the outside so as to be connected to either of a battery charger 123 and an external circuit (not shown). In this case, a switch 124 is connected to the common terminal 101, the battery charger 123, and the external circuit.

To charge the secondary battery 122, the switch 124 electrically couples the common terminals 101 with the battery charger 123. If the battery charger 123 produces a charging voltage higher than output voltage of the secondary battery 122, the secondary battery 122 is charged. Moreover, when the switch 124 couples the common terminal 101 with the external circuit, the output voltage of the secondary battery is regulated by the three terminal voltage regulator 100 and is supplied to the external circuit. Therefore, the three terminal voltage regulator 100 can be singly used for charging and discharging the secondary battery. Accordingly, the charging and discharging circuit becomes smaller in size and cheaper is cost than the conventional charging and discharging circuit which has two conventional three terminal voltage regulators, as illustrated in FIG. 5.

Figure 13:
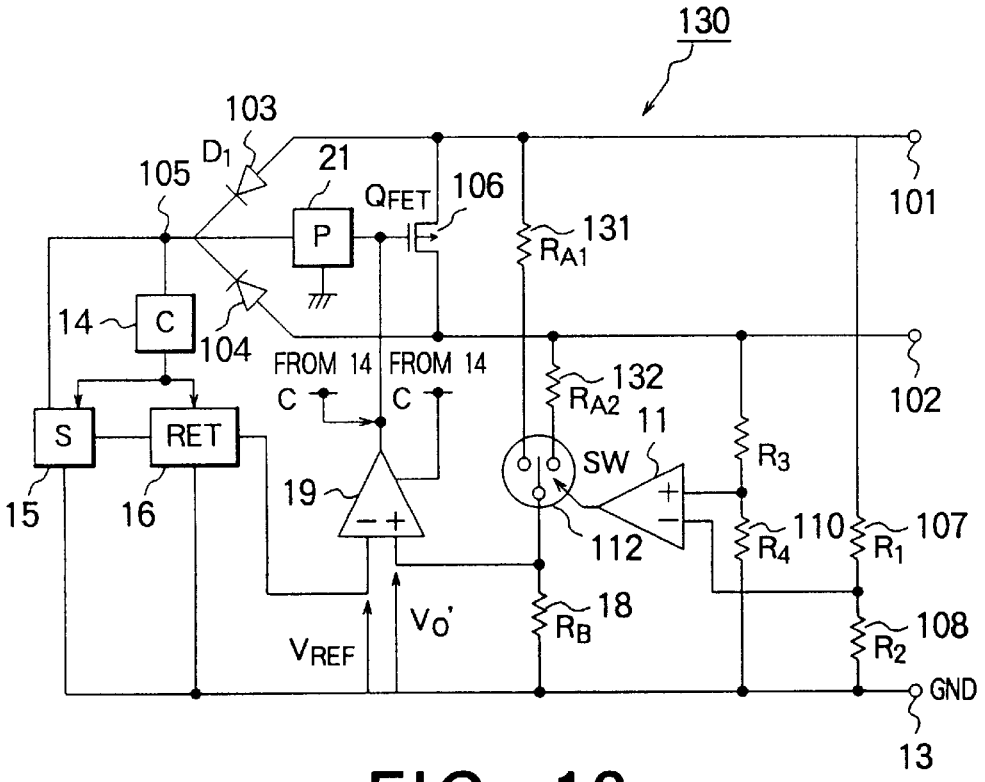
FIG. 13 is a block diagram of a three terminal voltage regulator according to another preferable embodiment of this invention.
Figure 14:
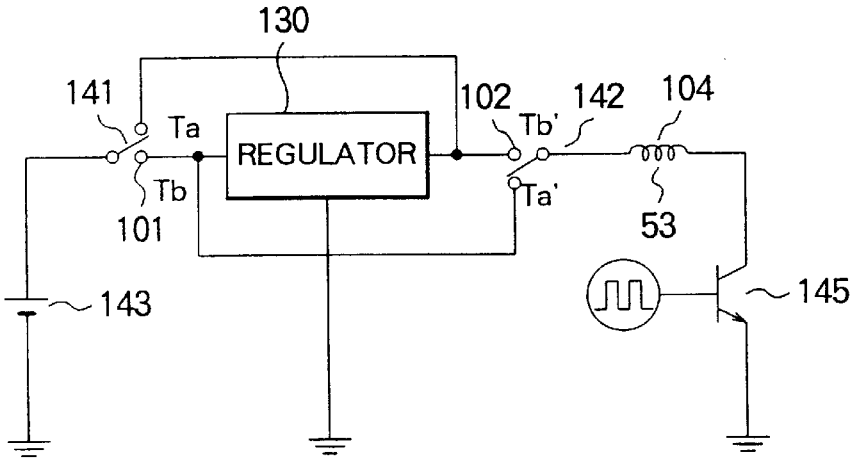
FIG. 14 is a block diagram of a driving circuit using the three terminal voltage regulator of FIG. 13.

Referring to FIGS. 13 and 14, description will be made about a three terminal voltage regulator according to another embodiment of this invention.

In FIG. 13, the three terminal voltage regulator 130 has a pair of resistors ($R_{A1}$) 131 and ($R_{A2}$) 132 in place of the dividing resistor 17 of FIG. 10. The resistors 131 and 132 have resistances which are different from each other. The resistor 131 is connected between the common terminal 101 and the switch 112 while the resistor 132 is connected between the common terminal 102 and the switch 112.

In this structure, when the higher voltage is given to the common terminal 102, the resistor 131 divides a first output voltage $V_O$ supplied to the common terminal 101 and produces a first divided voltage $V_O'$. On the other hand, when the higher voltage is given to the common terminal 101, the resistor 132 divides a second output voltage $V_O$ supplied to the common terminal 102 and produces a second divided voltage $V_O'$. Even if the higher voltage is fixed, the first output voltage $V_O$ and the second output voltage $V_O$ are different from each other. This is because the resistors 131 and 132 have the different resistances as mentioned above. For example, when the resistance of the resistor 131 is bigger than the resistance of the resistor 132, the first output voltage $V_O$ is higher than the second output voltage $V_O$.

The three terminal voltage regulator 130 can be used for a driving circuit of a motor which is driven by a voltage of two different levels. The motor is driven by a higher level of the voltage when the motor comes into a high speed operation or keeps high speed rotation. On the other hand, the motor is driven by lower level of the voltage when the motor into a low speed operation or keeps low speed rotation. The driving circuit is shown in FIG. 14.

In FIG. 14, the common terminal 101 is connected to both a terminal Tb of the switch 141 and a terminal Ta' of the switch 142. The common terminal 102 is connected to both a terminal Tb' of the switch 142 and to a terminal Ta of the switch 141. When the switch 141 selects the terminal Ta and the switch 142 selects the terminal Ta', the common terminal 102 is supplied with the input voltage from a power source 143 and the common terminal 101 provides the output voltage, for example, the higher voltage, to an exciting coil 144 of the motor. The motor has a speed control transistor 145 which is controlled by a control signal. On the other hand, when the switch 141 selects the terminal Tb and the switch 142 selects the terminal Tb', the common terminal 101 is supplied with the input voltage and the common terminal 102 provides the output voltage, for example, the lower voltage, to the exciting coil 144. Therefore, the three terminal voltage regulator is singly operable in voltages of two different levels. Accordingly, the driver circuit is smaller and cheaper than a conventional driver circuit which has two of the conventional three terminal voltage regulators.

What is claimed is:

1. A voltage regulator for regulating an input voltage into an output voltage stabilized, said voltage regulator comprising:

a pair of common terminals one of which is used as an input terminal for said input voltage and the other of which is used as an output terminal for said output voltage;

a pair of rectifying diodes which are connected to said common terminals, respectively, and which are connected to each other at a point of connection therebetween, for rectifying a current from said common terminals to said point to supply said input voltage to said point, detecting means for detecting said output voltage to produce a detecting voltage proportional to said output voltage, control means connected to said point and said detecting means for producing a control signal in response to said input voltage and said detecting voltage, output amplifying means connected to said common terminals and said control means for amplifying said input voltage supplied from one of the common terminals in response to said control signal to produce said output voltage which is provided to the other of the common terminals, and selecting means connected to said common terminals and said detecting means for selectively electrically coupling said detecting means with one of the common terminals to supply said output voltage to said detecting means.

2. A voltage regulator as claimed in claim 1, wherein said control means comprises:

a reference voltage producing means which is connected to said connecting point and which produces a reference voltage in response to said input voltage, and error amplifying means, which is connected to said reference voltage producing means and said detecting means, for amplifying an error voltage between said reference voltage and said detecting voltage to produce an amplified error voltage as said control signal.

3. A voltage regulator as claimed in claim 2, said voltage regulator further comprising a ground terminal, wherein said reference voltage producing means comprises:

a constant current source which is connected to the point and which produces a constant current, a start-up circuit, which is connected to said point, said constant current source, and the ground terminal, for producing a start-up signal in response to said input voltage, and a reference signal producing circuit, which is connected to said constant current source, said start up circuit, and said ground terminal, for producing said reference voltage in response to said start up signal.

4. A voltage regulator as claimed in claim 1, said voltage regulator further comprising a ground terminal, wherein said detecting means comprises a pair of dividing resistors which is connected between said selecting means and said ground terminal and which divides said output voltage to produce a divided voltage as said detecting voltage.

5. A voltage regulator as claimed in claim 1, wherein said selecting means comprises:

a switch which is connected to said common terminals and said detecting means and which electrically couples said detecting means with one of the common terminals in response to a switching control signal, and switch control means which is connected to said common terminals and said switch for producing said switching control signal in response to said input voltage and said output voltage supplied from said common terminals.

6. A voltage regulator as claimed in claim 5, said voltage regulator further comprising a ground terminal, wherein said switch control means comprises:

a pair of dividing resistor couples that is connected between said common terminals and said ground terminals and that produces a pair of divided voltages, and a comparator which is connected to said dividing resistor couples and said switch and which compares said divided voltages with each other to produce a result signal as said switching control signal.

7. A voltage regulator as claimed in claim 1, said voltage regulator further comprising a ground terminal, wherein said detecting means comprises a pair of first resistors which are connected to said common terminals, respectively, and a second resistor which is connected to said ground terminal, said selecting means comprising a switch connected to said first resistors and said second resistor for electrically coupling said second resistor with one of the first resistors.

8. A voltage regulator as claimed in claim 7, wherein said selecting means comprises switch control means, which is connected to said common terminals and said switch, for producing a switching control signal for controlling said switch in response to said input voltage and said output voltage supplied from said common terminals.

9. A voltage regulator as claimed in claim 8, wherein said switch control means comprises:

a first pair of dividing resistors, that is connected between one of the common terminals and said ground terminal, for producing a first divided voltage, a second pair of dividing resistors, that is connected between the other common terminal and said ground terminal, for producing a second divided voltage, and a comparator, which is connected to said first and second pairs and said switch, for comparing said first divided voltage with said second divided voltage to produce a result signal as said switching control signal.

10. A voltage regulator as claimed in claim 1, wherein said output amplifying means is an MOSFET.

11. An electric circuit which has first, second, and third terminals and which is operable in response to an input voltage to produce an output voltage, said electric circuit comprising:

circuit means connected to said first and second terminals for putting each of said first and said second terminals into states of receiving both said input voltage and said output voltage; and determining means coupled to said circuit means for determining the first and the second terminals as input and output terminals to receive the input voltage between the input terminal and the third terminal and to produce the output voltage between the output terminal and the third terminal.

12. An electric circuit as claimed in claim 11, wherein said input and said output voltage have a voltage difference;

said circuit means comprising:

operating means for carrying out operation in response to a selected one of the input and the output voltages; and means coupled to said operating means for rendering the first and the second terminals into common terminals operable as both the input and the output terminals.

* * * * *